United States Patent [19]

Knodel et al.

[11] Patent Number: 4,509,902

[45] Date of Patent: Apr. 9, 1985

[54] POWER REGULATING DEVICE FOR A HYDROSTATIC PUMP

[75] Inventors: Emil Knodel, Stuttgart; Gerhard Nonnenmacher, Korntal, both of Fed. Rep. of Germany

[73] Assignee: Robert Bosch GmbH, Stuttgart, Fed. Rep. of Germany

[21] Appl. No.: 481,264

[22] Filed: Apr. 4, 1983

[30] Foreign Application Priority Data

Apr. 10, 1982 [DE] Fed. Rep. of Germany ..... 3213377

[51] Int. Cl.[3] ..... F04B 49/00

[52] U.S. Cl. ..... 417/216; 417/220

[58] Field of Search ..... 417/216, 218–222; 60/445, 447, 452, 428, 486

[56] References Cited

U.S. PATENT DOCUMENTS 3,924,969 12/1975 Rometsch et al. ..... 417/218
3,969,896 7/1976 Louis ..... 60/452 X
4,013,381 3/1977 Hein et al. ..... 60/452 X
4,067,664 1/1978 Robeller ..... 417/218
4,158,529 6/1979 Nonnemacher et al. ..... 60/447 X

*Primary Examiner*—Edward K. Look
*Attorney, Agent, or Firm*—Michael J. Striker

[57] ABSTRACT

A power regulating device for a hydrostatic pump with at least one pressure-loaded piston which adjusts a stroke-varying member and is controlled by a valve with two springs acting upon one side of the valve and a gauge piston loaded by the delivery pressure and a lever through which a force proportional to the delivery pressure acts upon the other side of the valve, is provided with an additional spring which acts upon the gauge piston via an intermediate member in the same direction in which the delivery pressure acts, and with a second pressure medium source arranged to act with a variable control pressure upon the intermediate member against the additional spring.

5 Claims, 3 Drawing Figures

POWER REGULATING DEVICE FOR A HYDROSTATIC PUMP

BACKGROUND OF THE INVENTION

The present invention relates to a power (output) regulating device for a hydrostatic pump.

Power regulating devices of the above mentioned general types are known in the art. In a known power regulating device, a stroke-varying member of a hydrostatic pump is adjusted with the aid of at least one pressure-loaded piston against a counterforce, the piston is controlled by a valve, and two springs act upon the valve at its one side, whereas the other side of the valve is acted upon by a force proportional to the delivery pressure via a gauge piston loaded by the latter and a lever. In the power regulating device designed as described hereinabove, it is possible to approach the working point which lies approximately on a hyperbola in a PQ diagram. Such a device possesses, however, the disadvantage that the point below the power hyperbola can be controlled only by an auxiliary pressure which can lead in certain conditions to failures or must be arranged in a main stream of a loss-susceptible throttle.

Several patents in similar fields have been issued to the second listed inventor of the present regulating device.

SUMMARY OF THE INVENTION

Accordingly, it is an object of the present invention to provide a power regulating device for a hydrostatic pump which avoids the disadvantages of the prior art.

More particularly, it is an object of the present invention to provide a power regulating device for a hydrostatic pump in which resetting of the pump is possible by decreasing, instead of increasing, the control pressure.

It is also an object of the present invention to provide a power regulating device for a hydrostatic pump in which a desired point below the power hyperbola can be reached.

In keeping with these objects and with others which will become apparent hereinafter, one feature of the present invention resides, briefly stated, in a power regulating device with a pressure-loaded piston adjusting a stroke-varying member and controlled by a valve with two springs acting upon its one side and a gauge piston and a lever through which a force proportional to the delivery pressure is applied at the other side, wherein an additional spring is provided acting upon the gauge piston via an intermediate member in the same direction in which the delivery pressure acts upon the gauge piston, and a second pressure medium source is arranged to act with a variable control pressure upon the intermediate member against the additional spring.

When the pressure regulating device is designed in accordance with the present invention, resetting of the pump is performed by a decreasing control pressure instead of an increasing control pressure. A desired point below the power hyperbola can be reached. In such a device, a failure danger, for example in the event of decrease of the control pressure, is eliminated. Also, losses caused by a throttle which is frequently arranged in the main delivery conduit are avoided.

In accordance with another feature of the present invention, the intermediate piston is formed as a differential piston with an annular surface upon which the control pressure of the second pressure medium source acts.

Yet another feature of the present invention is that the second pressure medium source is formed as an auxiliary pump, and a pressure limiting valve is connected with the auxiliary pump parallel to the intermediate member.

A further feature of the invention is that a throttle is arranged in a conduit of the auxiliary pump.

Finally, a by-pass valve can be provided, which is connected in series with the pressure regulating valve, loaded by a working pressure of the pump, and arranged to establish communication between a delivery conduit of the auxiliary pump and a container.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENT

Figure 1:
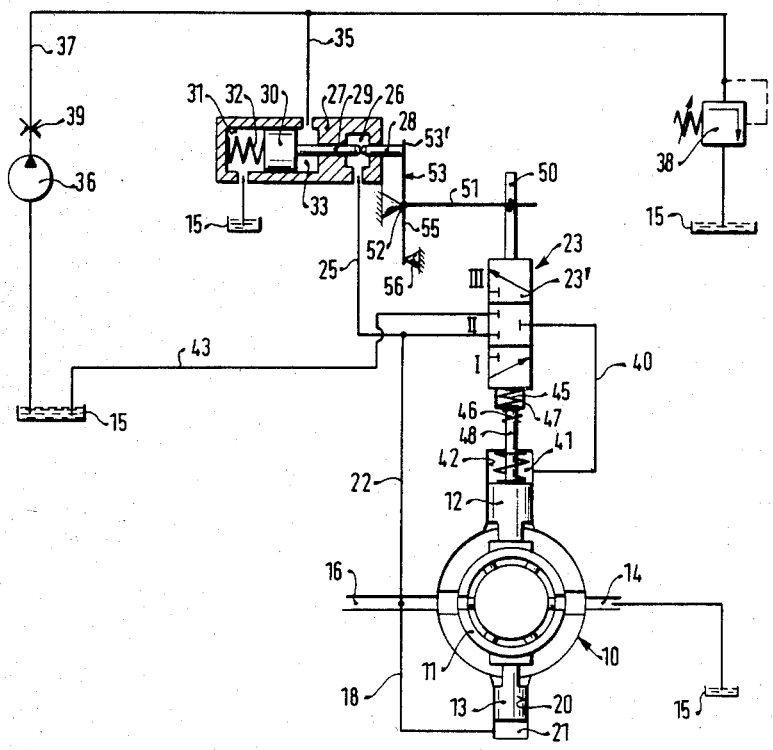
FIG. 1 is a view schematically showing a pressure regulating device with an adjusting pump in accordance with the present invention.

FIG. 1 shows a radial piston pump which is identified with reference numeral 10. A lifting ring 11 of the pump is adjusted with the aid of adjusting pistons 12 and 13 which act in mutually opposite directions. The adjusting piston 12 has a diameter considerably exceeding the diameter of the adjusting piston 13.

The radial piston pump 10 aspirates a pressure medium via a conduit 14 from a container 15 and displaces it into a delivery conduit 16. A conduit 18 branches off from the delivery conduit 16 and leads to a pressure chamber of an opening 20 which receives the adjusting piston 13. A further conduit 22 also extends from the delivery conduit 16 and leads to a control valve 23. The latter is formed as a 3/3-way valve with switching positions I, II and III.

A conduit 25 extends from the control valve 23 and opens into a first pressure chamber 26 of a housing 27. A gauge piston 28 is inserted in the housing 27. A plunger 29 of a differential piston 30 is also inserted in the pressure chamber 26. The piston 30 is guided in an opening 31 of the housing 27. The piston 30 has a considerably greater diameter than the plunger 29. A pressure spring 32 is located in the opening 31, and more particularly in its part facing away from the plunger 29. The pressure spring 32 acts upon the piston 30.

A front part of the opening 31 forms a pressure chambers 33. A conduit 35 extends from a conduit 37 connected with an auxiliary pump 36 and opens into the pressure chamber 33. The auxiliary pump aspirates the pressure medium from the container 15. At the end of the conduit 37, an advantageously adjustable pressure-limiting valve 38 is arranged. A throttle 39 is located in the conduit 37 behind the pump 36.

A conduit 40 leads from the control valve 23 to a pressure chamber 41 of an opening 42 which receives the adjusting piston 12. Further, a conduit 43 leads from the container 15 to the control valve 23.

Figure 3:
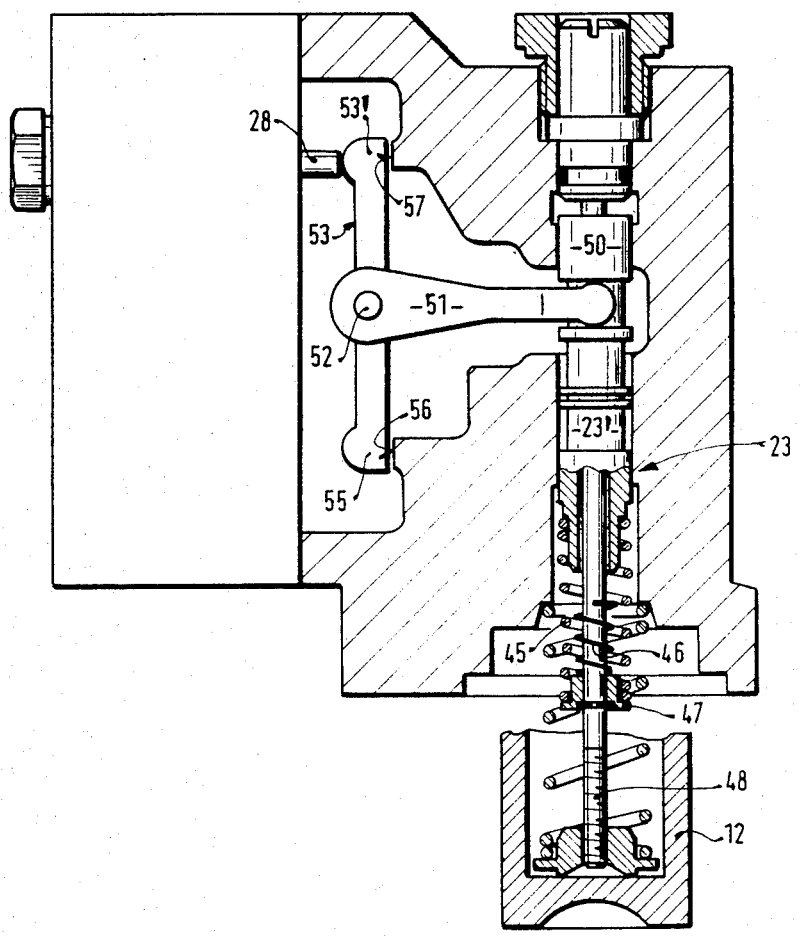
FIG. 3 is a view showing a fragment of the pressure regulating device of FIG. 1 on an enlarged scale.

Two pressure springs 45 and 46 act upon the control valve 43. These pressure springs are schematically shown in FIG. 1, and more clearly shown in FIG. 3. The springs act upon a control slider 23' of the control valve 23, and particularly one after the other. Both springs 45 and 46 are supported on a spring plate 47 which is mounted on a follow-up rod 48. The latter is supported, in turn, on a bottom of the adjusting piston 12. The control slider 23' always abuts against the spring 45. It abuts, however, against the spring 46 after a certain adjustment. They come in engagement after one another, so that approximately a hyperbolic characteristic line of pressure and volume is obtained. Such an arrangement is known in the art. The follow-up rod 48 extends through the hollow interior of the control slider 23'.

A projection 50 is provided on the control valve 23 at the side facing away from the pump. An arm 51 of an angular lever 53 which pivots about a housing-fixed pivot axle 52 is articulately connected with the projection 50. The gauge piston 28 abuts against an end 53' of the arm 53. The angular lever 53 has an extension 55 which cooperates with an abutment 56. A similar abutment 57 is located at the opposite end of the angular lever.

The regulating arrangement in accordance with the present invention operates in the following manner:

It is assumed that the adjusting piston 12 with the great surface displaces the lifting ring 11 of the pump, and the pump displaces the pressure medium into the delivery conduit 16. The pressure acting in the delivery conduit propagates via the conduit 18 into the pressure chamber 21 of the adjusting piston 13, and also via the conduits 22 and 25 into the pressure chamber 26 of the gauge piston 28. It is further assumed that the auxiliary pump 36 fully delivers, whereby the differential piston 30 is pressed against the force of the spring 32 to the left and the plunger 29 does not contact the gauge piston 28. When the pressure in the delivery conduit 16 attains a predetermined limiting value, the angular lever 53 is turned by the force of the gauge piston 28 about the pivot axle 52 and brings the control valve 28 from its previous neutral position II into the position III. Thereby the pressure medium can flow from the pressure chamber 41 via the conduits 40 and 43 to the container 15. In the pressure chamber 21 the delivery pressure acts as before, so that the pump is now reset to smaller delivery quantity. Thereby the springs 45 and 46 are stressed more strongly, and they displace the control valve 23 again to its neutral position II. The angular lever 53 displaces the gauge piston 28 to its previous position.

When the pressure reverses, the pressure spring 45 and/or the pressure spring 46 bring the control valve 23 into its switching position I. Now the pressure medium can flow via the conduits 22 and 40 into the pressure chamber 41 and the pump 10 is again adjusted to greater delivery quantity. Thereby the force of the springs 45 and 46 decreases, the gauge piston 28 turns the angular lever 53, and the latter brings the control valve 23 again to its neutral position II. By the arrangement of the pressure springs 45 and 46 which come into engagement one after the other, in approximate power hyperbola is obtained in a PQ-diagram.

The nominal pressure produced in the conduit 37 of the auxiliary pump 36 depends upon a cut-off pressure of the pressure-limiting valve 38. When this control pressure is reduced relative to the now present normal value, for example by reduction of the cut-off pressure at the pressure valve 38, the pressure in the pressure chamber 33 decreases. The spring 32 presses the differential piston and its plunger 29 against the gauge piston 28 and simulates at it a working pressure which is greater than the momentary pressure which acts in the delivery conduit 16. Thereby the angular lever 53 is turned, and the valve 23, as described hereinabove, is adjusted so that the pump 10 is adjusted to smaller delivery quantity. It can be understood that in the event of failure or hazardous reduction of the control pressure in the conduit 37, the resetting of the pump 10 is provided via decreasing instead of increasing control pressure. Thereby an eventually occurring accident danger is eliminated.

When the working pressure acting in the delivery conduit 16 applies actually a higher force onto the gauge piston 28 than corresponds to the action of the spring force 32 minus the control pressure 35, the adjustment of the pump 10 again follows the above mentioned power hyperbola. It is thereby guaranteed that the pump 10 is adjusted always to the smaller of both nominal values from the working pressure in the delivery conduit 16 or the control pressure in the conduit 35. When the control pressure decreases to a very low value, or zero, the force of the spring 32 on the differential piston and thereby on the gauge piston 28 is so high that the pump is reset to zero.

Figure 2:
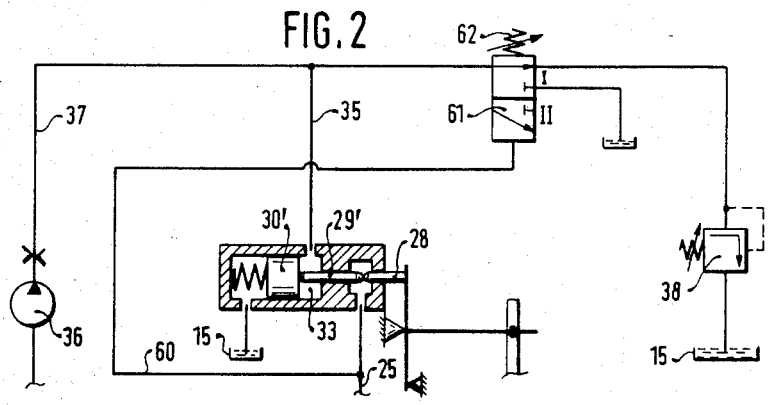
FIG. 2 is a view substantially corresponding to the view of FIG. 1 but showing a second embodiment of the inventive pressure regulating device.

The embodiment of the inventive arrangement shown in FIG. 2 differs from FIG. 1 in that a conduit 60 branches off from the conduit 25 and leads to an end side of a 3/2-way valve 61 which is loaded against this pressure force by a spring 62. The valve 61 is arranged in the conduit 37.

In this embodiment the control pressure which acts in the conduit 37 can be influenced by the working pressure acting in the delivery conduit 16. When the latter reaches a certain value, the valve 62 is switched from its throughflow position I into the position II, so that the pressure medium flows directly from the conduit 37 to the container 15. Thereby the pressure in the pressure chamber 33 decreases very quickly, so that the pump 10 is immediately reset (pressure cut off).

In this embodiment, the differential piston, moreover, is subdivided into a separate piston 30' and a plunger 29' for facilitating its manufacture. The functions of the differential piston, however, remain the same.

It will be understood that each of the elements described above, or two or more together, may also find a useful application in other types of constructions differing from the types described above.

While the invention has been illustrated and described as embodied in a power regulating device for a hydrostatic pump, it is not intended to be limited to the details shown, since various modifications and structural changes may be made without departing in any way from the spirit of the present invention.

Without further analysis, the foregoing will so fully disclose the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A power regulating device for a hydrostatic pump with a stroke-varying member, comprising a pressure medium source;

at least one pressure-loaded piston adjusting the stroke-varying member against a counterforce and being pressure loaded by said pressure medium source;

a valve controlling said adjusting piston and having two sides;

two springs acting upon said valve at its one side;

a gauge piston loaded by a delivery pressure in a predetermined direction and a lever applying a force proportional to the delivery pressure to said valve at its other side via said gauge piston and said lever;

an intermediate member;

an additional spring acting upon said gauge piston via said intermediate member in the same direction in which the delivery pressure acts upon said gauge piston; and a second pressure medium source acting with a variable control pressure upon said intermediate member against said additional spring.

2. A power regulating device as defined in claim 1, wherein said intermediate member is formed as a differential piston having an annular surface, so that said control pressure of said second pressure medium source acts upon said annular surface.

3. A power regulating device as defined in claim 1, wherein said second pressure medium source is formed as an auxiliary pump; and further comprising a pressure limiting valve connected with said auxiliary pump parallel to said intermediate member.

4. A power regulating device as defined in claim 3, wherein said auxiliary pump has a conduit; and further comprising a throttle arranged in said conduit of said auxiliary pump.

5. A power regulating device as defined in claim 3, wherein said auxiliary pump has a delivery conduit; and further comprising a container, and a by-pass valve connected in series with said pressure regulating valve, said by-pass valve being loaded by a working pressure of the pump and arranged to establish communication between said delivery conduit of said auxiliary pump and said container.

* * * * *